250-506.1
1/6/87 OR 4,634,875

United States Patent [19]
Kugeler et al.

[11] Patent Number: 4,634,875
[45] Date of Patent: Jan. 6, 1987

[54] TRANSITORY STORAGE FOR HIGHLY-RADIOACTIVE WASTES

[75] Inventors: Kurt Kugeler, Julich; Ulrich Jaroni, Aachen; Wieland Kelm, Herzogenrath; Peter W. Phlippen, Aachen; Peter Schmidtlein, Duisburg; Manfred Kugeler, Julich, all of Fed. Rep. of Germany

[73] Assignee: Kernforschungsanlage Julich Gesellschaft mit beschrankter Haftung, Julich, Fed. Rep. of Germany

[21] Appl. No.: 572,636

[22] Filed: Jan. 20, 1984

[30] Foreign Application Priority Data

Jan. 20, 1983 [DE] Fed. Rep. of Germany ..... 3301735

[51] Int. Cl.[4] ..... G21F 5/00
[52] U.S. Cl. ..... 250/506.1
[58] Field of Search ..... 250/506.1, 507.1; 376/272, 398, 399

[56] References Cited

U.S. PATENT DOCUMENTS

| | | | |
|---|---|---|---|
| 3,046,403 | 7/1962 | Montgomery | 250/507.1 |
| 3,113,215 | 12/1963 | Allen | 205/506.1 |
| 3,711,715 | 1/1973 | Bochard | 250/506.1 |
| 3,866,424 | 2/1975 | Busey | 376/298 |
| 3,911,685 | 10/1975 | Busey | 376/272 |
| 4,234,798 | 11/1980 | Baatz et al. | 250/506.1 |
| 4,272,683 | 6/1981 | Baatz et al. | 250/506.1 |
| 4,366,095 | 12/1982 | Takats et al. | 250/506.1 |
| 4,447,729 | 5/1984 | Doroszlai et al. | 250/507.1 |
| 4,470,950 | 9/1984 | Hyde | 250/506.1 |

FOREIGN PATENT DOCUMENTS

| | | | |
|---|---|---|---|
| 0005879 | 2/1970 | Japan | 250/506.1 |

OTHER PUBLICATIONS

D. E. Selects New Breeder Concepts, Nuclear Engineering International, Dec. 1984, p. 2.

*Primary Examiner*—Bruce C. Anderson
*Assistant Examiner*—Paul A. Guss
*Attorney, Agent, or Firm*—Scully, Scott, Murphy & Presser

[57] ABSTRACT

A transitory or temporary storage for highly radioactive waste, in which the transitory storage incorporates containers for the receipt of the waste, and a cooling system for the discharge of the heat which is produced during the storage of the waste. The cooling system incorporates a cooling air duct, as well as a coolant circuit for a coolant which is conveyed in a closed circuit between coolant conduits which conduct off heat generated in the storage space and a heat sink arranged externally of the storage space.

20 Claims, 5 Drawing Figures

TRANSITORY STORAGE FOR HIGHLY-RADIOACTIVE WASTES

BACKGROUND OF THE INVENTION

1. Field of the Invention

The present invention relates to a transitory or temporary storage vessel for highly-radioactive waste. The transitory storage vessel incorporates containers for the receipt of the waste, and a cooling system for the discharge of the heat which is produced during the storage of the waste. The cooling system incorporates a cooling air duct, as well as a coolant circuit for a coolant which is conveyed in a closed circuit between coolant conduits, which conduct away heat generated in the storage space, and a heat sink arranged externally of the storage space.

2. Discussion of the Prior Art

Transitory storages vessels serve for the repository of processed highly-radioactive wastes until their reuse or until their introduction into a permanent repository. Such wastes are produced during the reconditioning of nuclear fuel elements subsequent to their use in a nuclear reactor. However, radioactive wastes must also be removed during the production of radioactive fluorescent substances or from isotope laboratories.

The highly-radioactive materials are concentrated prior to their storage. The materials are embedded or introduced into suitable carrier substances, or as a calcinate, which is obtained during the reconditioning. Suitable, for example, as a carrier substance is borosilicate glass. Thus, it is known to encase the highly-radioactive materials within non-corrosive, gastight steel containers. The highly-radioactive waste is to be conveyed into repositories subsequent to its encapsulation, which act in a radiation-screening manner. In addition thereto, provision must be made to remove the heat which is produced during storage as a result of the decay of the radioactive material, which is designated as "decaying heat", so that the containers which contain the radioactive waste, and under certain circumstances, the carrier substance which contains the radioactive waste, is itself not overheated by the developed heat. Consequently, the repository is cooled.

U.S. Pat. No. 3,866,424 describes a storage for radioactive waste wherein waste capsules containing the waste are introduced into heater tubes which are filled with a refluxing coolant and, in addition thereto, traverse a cooling bath. The coolant of the cooling bath is conducted, within a primary cooling circuit, through a heat exchanger which is arranged externally of the storage space. In the heat exchanger, the coolant rejects the heat carried along therewith to a working medium circuit which includes a compressor and turbine. In order to provide for protection against overheating and redundancy of the system, auxiliary secondary cooling devices are provided for and cooling bath itself, and also for the coolant liquid which is located in the heater tubes. The activity in the function and safety of this known cooling system depends, above all, upon the cooling of the waste itself by means of the coolant liquid in the heater tubes. Thus, when leakages are encountered within the heater tubes, there must be expected considerable disturbances.

Another storage vessel for radioactive waste has become known from U.S. Pat. No. 3,911,684. In this storage vessel, the storage capsules, which are filled with waste, have cooling air circulated thereabout. The cooling air is conveyed in a closed circuit for economic utilization whereby, for example, the heat which is carried along can be transferred by means of a heat exchanger to a work medium of a work medium circuit which includes a turbine. Any redundancy of the system is not only achieved through the arrangement of further heat exchangers in the circuit of the cooling air, but provision is also made that, in the case of any disturbance, by means of the employment of natural convection, cooling air can flow into the storage space. It is disadvantageous that the cooling air can be conveyed within the storage space only with such difficulty so as to prevent any localized overheating. Upon the occurrence of a fracture in a storage tube, the highly-radioactive waste will then find itself directly in the cooling air flow.

SUMMARY OF THE INVENTION

Accordingly, it is an object of the present invention to provide a transitory repository in which, in addition to a utilization of the produced heat in the case of operation, there is afforded a uniform degree of heat removal even during any required emergency cooling. Concurrently, even at an undesireable overheating of the highly-radioactive waste, there should be afforded the secure encapsulation thereof with respect to the cooling media of the cooling system. In addition thereto, the transitory repository should be constructed as compactly as possible without any adverse influence on its safety.

The foregoing object is achieved in a transitory storage or repository of the above-mentioned type wherein an isolated storage container is introduced into the storage space, incorporates storage shifts adapted for filling with the waste. The storage shafts are arranged in the storage container in a region which is enclosed by coolant conduits that convey the coolant in a closed circuit for the removal of heat between the storage space and a heat sink. Due to the position of the coolant conduits directly in the storage container itself, a high degree of heat transfer is achieved between the storage shafts and the coolant conduits. In addition thereto, the storage container is encompassed by a cooling mantle provided with cooling air passageways, in which cooling air is conducted directly along the outer wall surface of the storage container. The cooling air serves for the emergency cooling of the system and can flow by either forced or open convection. During open convection, the quantity of air that is required to cool the storage space will adjust itself automatically. The air flow intensifies, as the storage container becomes warmer. During normal operation, the cooling air passageways are closed.

The storage container can be constructed with either a rectangular or circular cross-section. An extremely compact arrangement is obtained through construction of the storage container in a cylindrical configuration wherein openings for the highly-radioactive waste are provided in one of the axial ends of the storage container, parallel with the storage shafts extending along the container axis. The coolant conduits are arranged in the regions of the outer wall surface of the cylindrical storage container. These regions encompass the storage shafts.

In order to simplify the construction and the assembly of the storage vessel, and also to be able to correlate the volume thereof with the presently required storage capacity, the storage container is preferably made of centerable, interengageable components, with radiation-screening joints formed between the components. For cylindrically-shaped storage containers, the components can have the shape of cylindrical segments in which the storage shafts and coolant conduits extend. The manufacture of such segments is subject to increased demands. Suitably, there are thus provided cylindrically shaped components which can be assembled along their end surfaces. Seals can be inserted into annular grooves which are formed in the end surfaces.

In order to achieve a uniform temperature in the storage container, and to avoid localized overheating in the inner region of the storage shafts, the storage container also includes coolant conduits in the wall region of a central passageway. The passageway also serves to conduct cooling air, which flows through the passageway under the effect of open convection.

The sealing of the storage shafts is preferably done by cladding the storage shafts with liners. The liners are positioned flush against the shaft wall in order to obtain a good degree of heat transfer. In order to achieve the same object, the coolant conduits are retracted into recesses which are provided for this purpose in the storage container. Preferably, the coolant conduits are constructed of double-walled pipes which are connected to supply and return lines at the same side of the storage container. The inner region of the double-walled pipes serves as the inlet for the coolant, to the other end of the coolant conduit, whereas the warmed up coolant flows back in the outer annular region of the double-walled pipe. This will provide for a satisfactory heat transfer.

A high heat conduction and protective radiation screening is obtained by constructing the storage container from cast iron, spheroidal graphite iron or cast steel. When the storage container is assembled from components consisting of cast iron, spheroidal graphite iron or cast steel, these components are clamped together by means of tension cables which, for cylindrically-shaped components, extend in parallel with the container axis. In a spacesaving manner, the tension cables are located within tubular recesses in the storage container which extend in parallel with and intermediate the coolant conduits. In order to seal the clamped together components the joints therebetween are made gas-tight. For this purpose, seals can be inserted into the joints and preferably, the joints are welded together.

For safety reasons the storage space includes storage walls which are heat-resistant or protected against overheating. Suitably, the storage walls may be cooled by cooling air. For this purpose, auxiliary cooling air passageways extend in an space between the cooling mantle and the storage container.

The desired open convection of the cooling air is optimally obtained by a vertical arrangement of the storage container in the storage space, so that the storage container may be filled from above with waste. For the introduction of the cooling air, cooling air conduits extend within the storage walls, which connect at the bottom of the storage space into a distributing chamber, from which the cooling air flows to the individual cooling air passageways. The cooling air passageways are connected to the distributing chamber and lead to a cooling air collecting chamber for the discharge of the heated cooling air, and which has a cover including at least one discharge opening for the cooling air. In order to provide the cooling air with free access to the cooling air passageways, the storage container and the cooling mantle rest on supports which are arranged in the distributing chamber so that the cooling air circulates about those supports Suitably, the cooling air passageways consist of elements which are open towards the storage container. Legs of these elements face towards the outer wall surface of the storage container, so that cooling air will flow in the remaining interspace between the elements and the outer wall surface of the storage container. This configuration of the cooling air passageways, provision is made not only for an improved guidance of the cooling air along the outer wall surface of the storage container which is adapted for the heat transfer, and also results in a larger heat transfer surface, inasmuch as the entire surface of the cooling passageways, which stands in heat exchange with the outer wall surface of the storage container, is utilized for heat discharge to the cooling air.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
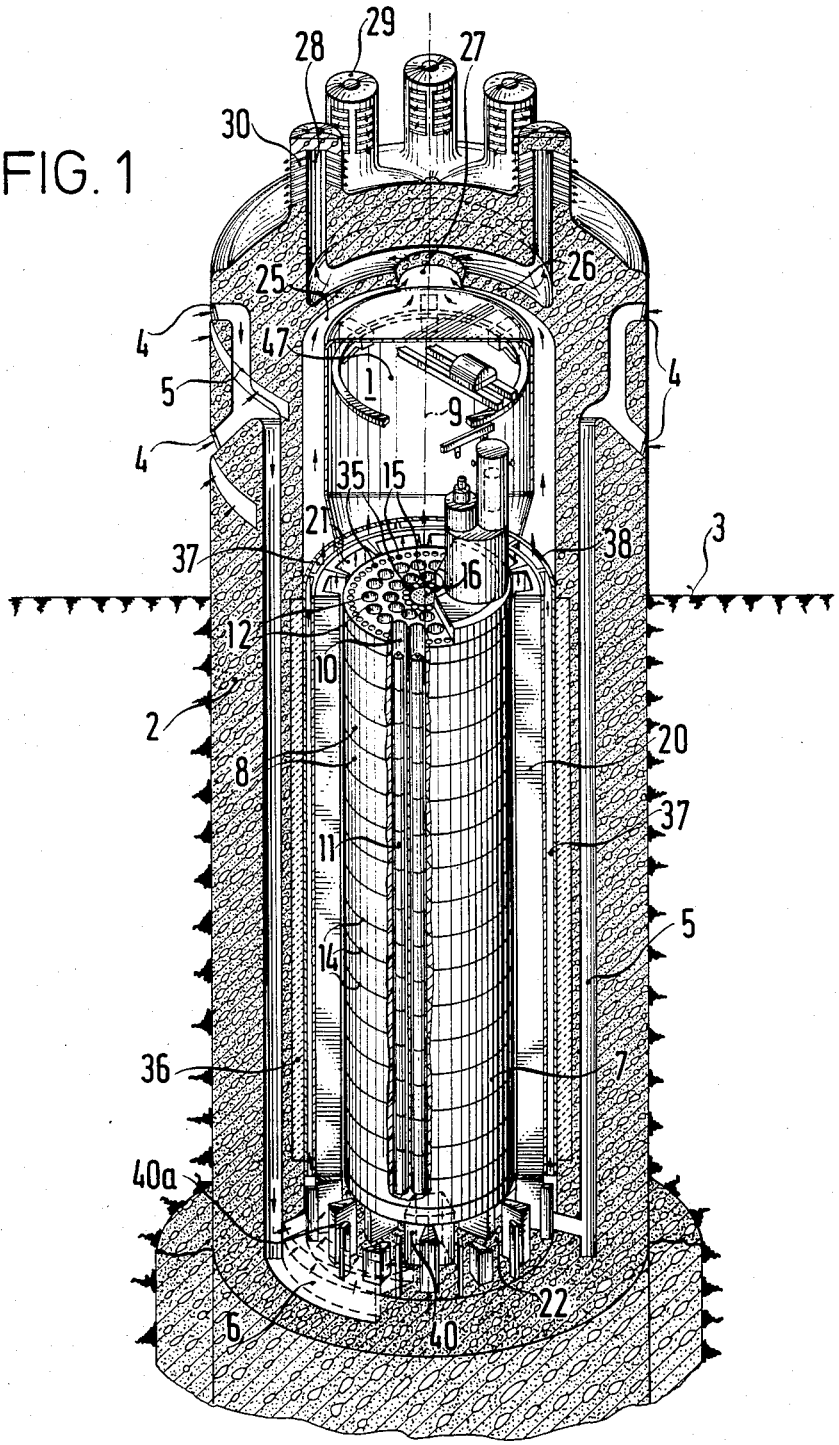
FIG. 1 illustrates, in perspective a generally longitudinal and partly sectional view of a transitory or temporary storage vessel pursuant to the invention.
Figures 2, 2A:
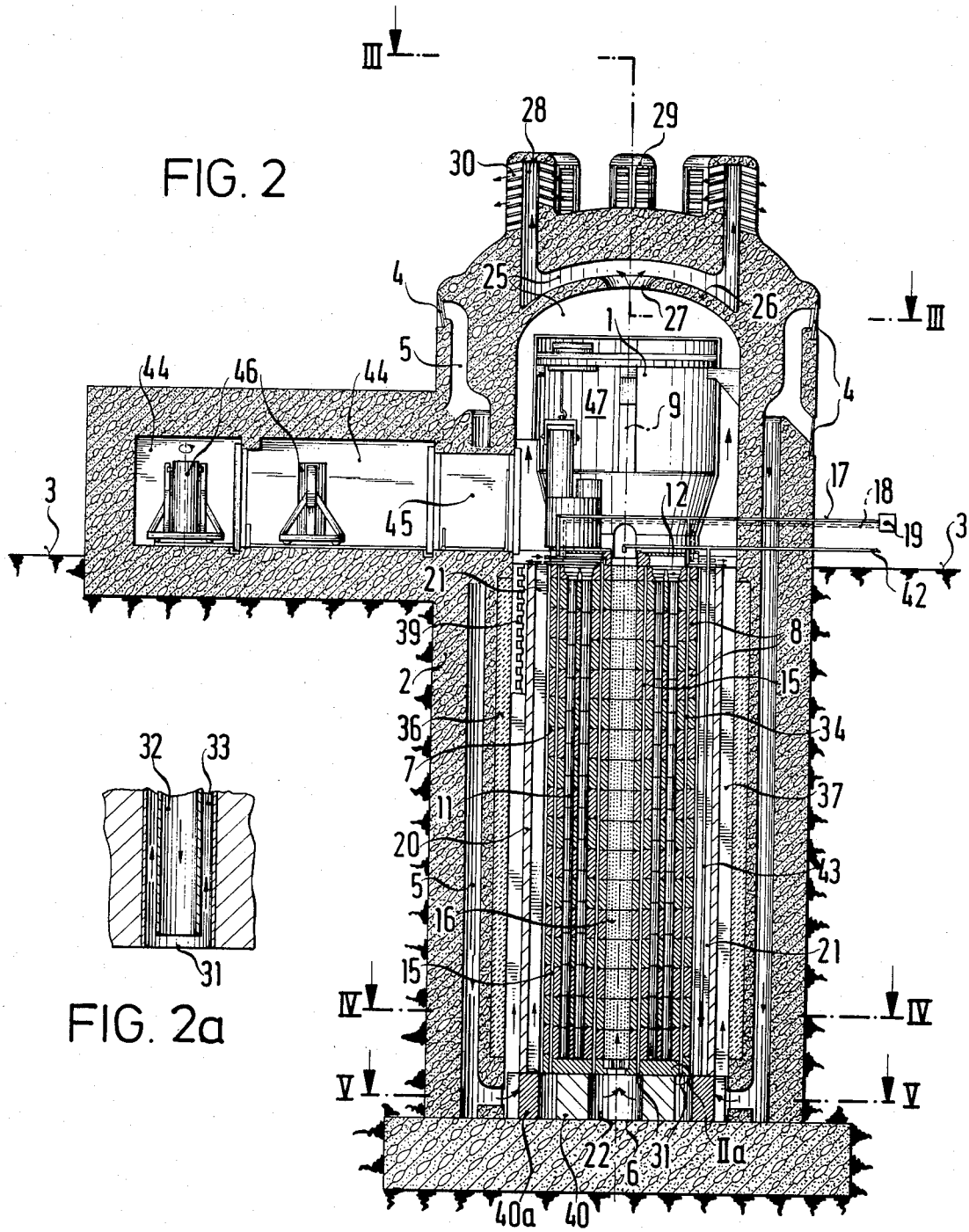
FIG. 2 illustrates a longitudinal section through the transitory storage vessel of FIG. 1.
Figure 3:
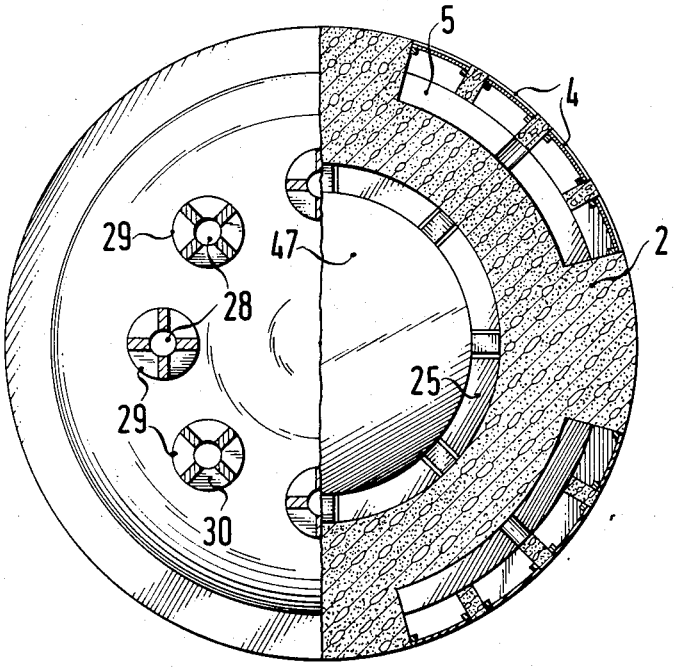
FIG. 3 illustrates a sectional view through the transitory storage vessel taken along line III—III in FIG. 2.

FIGS. 1 and 2 show a transitory storage vessel comprising a storage chamber or space 1 whose storage walls 2 are embedded in the ground over about two-thirds the length of walls 2. In FIGS. 1 and 2, the surface of the ground is identified by reference numeral 3. The portion of the storage walls 2 which project above the surface of the ground incorporates inlet openings 4 for cooling air which can flow through closeable cooling air conduits 5 in the storage walls 2 to the bottom 6 of the storage space 1.

Arranged within the storage space 1 is a storage container 7 which, in order to simplify its assembly, consists of a large number of cylindrical parts 8 which are superimposed so as to be centerable at their end surfaces. Storage shafts 10 extend within the storage container 7, parallel with the container axis 9, and into which the waste capsules 11 can be lowered through filler openings 12 in the upper end surface of the cylindrical storage container 7 which, in the exemplary embodiment, is arranged vertically in the transitory storage vessel. Each filler opening 12 can be closed by means of a removable, gas-tight cover system, whose extent of hermetic sealing can be controlled.

The waste capsules 11 are filled with highlyradioactive waste. In the exemplary embodiment, the waste capsules contain radioactive substances which are embedded in borosilicate glass. The waste capsules themselves consist of stainless high-grade alloy steel. Waste which is obtained as a calcinate can be introduced into the storage shafts 10, in lieu of the vitrified radioactive waste To provide for hermetic sealing, the storage shafts are clad with a liner 13 (FIG. 4) constituted of high-grade alloy steel The liner is closely fitted to the shaft wall, and thus improves the heat transfer between the waste capsules 11 and the storage shafts 10. The cover system on the filler openings 12 is also constructed so as to be hermetically sealing and radiation screening. The joints 14 between the components 8 are constructed so as to provide radiation screening. For this purpose, the end surfaces of the components evidence annularly extending shoulders which prevent any direct passage of radiation.

Figure 4:
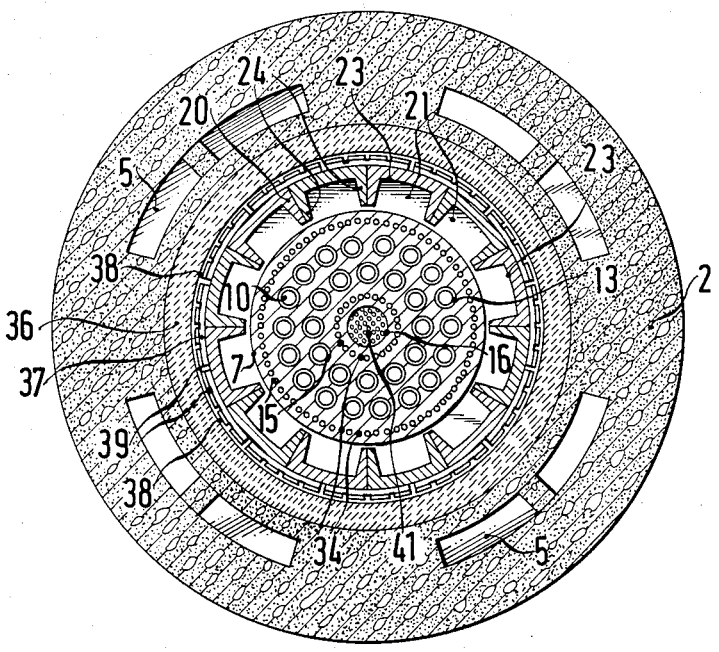
FIG. 4 illustrates a sectional view through a transitory storage taken along line IV—IV in FIG. 2.
Figure 4A:
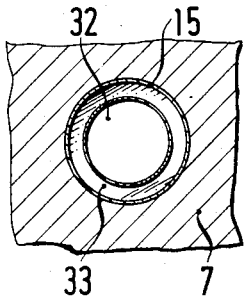
Figure 4B:
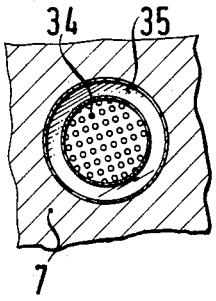
Figure 5:
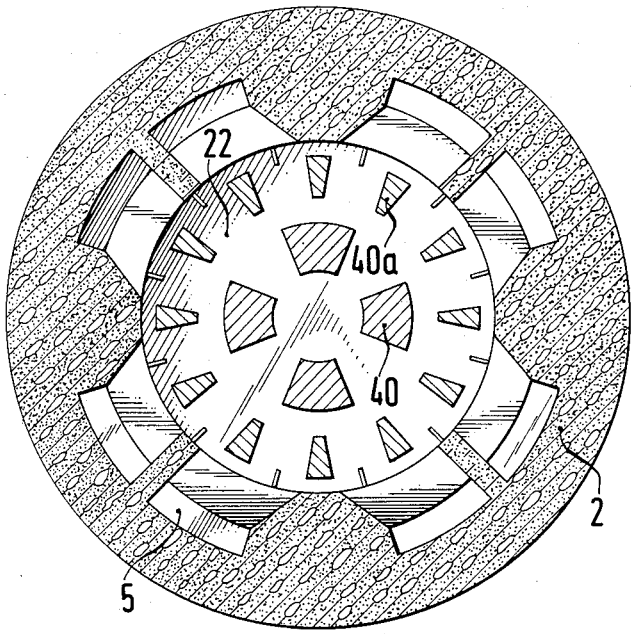
FIG. 5 illustrates a sectional view through a transitory storage taken along line V—V in FIG. 2.

With reference to FIG. 4, the storage shafts 10 are arranged in the storage container 7 within a region which is encompassed by coolant conduits 15. The coolant conduits extend along the external cylindrical wall of container 7 and also adjacent a central passageway 16, in parallel with the container axis 9, and thus encompass the region of the storage container 7 in which the storage shafts 10 are located. A coolant flows within the coolant conduits 15, which is conveyed in a closed circuit, as is schematically illustrated in FIG. 2. The coolant flows into the coolant conduits 15 through an inlet 17, and is heated within the coolant conduits through the heat discharged from the radioactive waste and generated in the storage shafts. By means of a discharge 18, the heated coolant is conveyed to a heat sink 19, which for example, may be a heat exchanger in which the coolant gives up the heat conducted along therewith. The heat can also be transferred to the work medium of a work medium circuit which includes a turbine, or directly conducted to a consumer.

Besides the cooling of the storage container 7 by means of the coolant which is conveyed in the above described closed circuit, an emergency air cooling system is also provided. To conduct this cooling air, the storage container 7 is encompassed by a cooling mantle or jacket 20 including cooling air passageways 21 in which the cooling air flows along in open convection along the outer wall surface of the storage container 7. The cooling air passageways 21 communicate at the bottom 6 of the storage space 1 with a distributor chamber 22 into which the cooling air can pass from the open environment about the transitory storage vessel after the cooling air conduits 5 in the storage wall 2 are opened. The cooling air passageways 21 are constructed to fact the outer wall surface of the storage container 7, as can be ascertained from FIGS. 1 and 2. With reference to FIG. 4, passageways 21 each consist of an element 23 which is U-shaped in cross-section, whose legs 24 point towards the outer wall surface of the storage container 7. Consequently, a space is formed between the outer wall surface of the storage container and the inner wall surfaces of the U-shaped element 23, which serves for the guidance of the cooling air. The cooling air flows upwardly through the cooling air passageways 21 from below, is heated through absorption of the heat produced in the storage container, and exits into a cooling air plenum or collecting chamber 25. Chamber 25 includes a cover 26 which is provided with a discharge opening 27 for the discharge of the heated cooling air. The cooling air is conveyed to and discharged into the open environment through air vent flues 28 in ventilation towers 29, which include a large number of air outlet slits 30.

Cooling air from the distributing chamber 22 is also conveyed to the storage container 7 through the central passageway 16. The passageway 16, as well as the remaining cooling air passageways 21, extends from the distributing chamber 22 to the cooling air collecting chamber 25. Also the heated cooling air which flows out of the central passageway 16 is conveyed through the air vent flue 28 into the open environment.

Within the storage container 7, the coolant conduits 15 are located in recesses, which are provided in the components 8, subsequent to the assembly of the components. The coolant conduits thus exhibit a good heat-conductive contact in the storage container 7. Coolant conduits of the exemplary embodiment are constructed as double-walled pipes, which are closed off at their lower end 31 to form a gap between the inner conduit space 32 and an annular space 33. inlet 17 is connected the upper end of the double-walled pipe to conduct the coolant into the inner conduit space 32, while the outlet 18 communicates with the annular space 33. The coolant thus flows initially through the coolant conduit within the inner conduit space 32, is reversed at the lower end 31, and conveyed within the annular space 33 to the outlet 18. The heat takeup is hereby effected essentially within the annular space 33 of the coolant conduit.

In the illustrated embodiment, the components 8 consist of cast steel in order to obtain a high heat conductivity between the storage shafts 10 and the coolant conduits 15, as well as towards the outer wall surface of the storage container 7 along which the cooling air passes. The components 8 are clamped together by means of tension cables 34. The tension cables extend in tubular apertures or openings 35 which are arranged in the outer wall region of the storage container between the coolant conduits 15. Obtained thereby is a compact and space-saving construction for the storage container 7. Clamping the components 8 together is necessary to hole the components together, particularly in instances of disturbances. The radioactive waste which is introduced into the storage shafts 10 will thus always remain securely encapsulated. In order to prevent the exit of gases, the components 8 are welded both interiorly and externally along their joints 14. In lieu of welding the components together, seals can be inserted into annular grooves formed in the end surfaces of the components.

The storage walls 2 of the storage chamber 1 are constructed either of a heat-resistant material, for example, cast iron or, as shown in the exemplary embodiment, are protected from overheating. For this purpose, in the regions of the storage walls which consist of concrete, which bound the storage space 1, there is introduced an overheating protection 36 of fireproof clay. In addition thereto, external air cooling passageways 37 are provided in the wall region. As shown in FIG. 4, these cooling air passageways are formed by means of cooling ring segments 38 which are positioned in the interspace present between the cooling mantle or jacket 20 of the storage container 7 and the storage walls 2. The outer cooling air passageways 37 are constructed so as to be open facing towards the cooling mantle 20. The storage wall includes flow ribs 39 which, by causing a swirling in the cooling air flow, counteract any overheating of the storage wall.

A water cooling arrangement which is not illustrated in the drawings, is also provided in the region of the cooling air passageways. The heat which is absorbed by the cooling water, in the exemplary embodiment, serves for the preheating of warm water which may be conveyed to a consumer.

Supports 40, on which the storage container 7 rests are arranged within the distributing chamber 22. Supports 40*a* are provided for the cooling mantle 20, as well as for the outer cooling air passageways 37. Cooling air introduced into distributing chamber 22 circulate about supports 40 and 40*a* so that the cooling air can pass into all passageways of the cooling air system. In this way, provision is made for the cooling of the foundation at the bottom 6 of the storage space 1, as well as for the cooling of the supports 40, 40*a* themselves.

In the illustrated embodiment, the central passageway 16 is filled with trickling members 41 along which a liquid coolant can stream downwardly, and which can be introduced through an inlet conduit 42 into the storage space 1. The inlet conduit 42 connects with the upper end of the central passageway 16 and, in case of emergency, is opened when, in addition to the emergency cooling of the transitory storage by means of cooling air or in lieu of this air cooling, further cooling of the storage container 7 is desired. The coolant which streams in through the inlet conduit 42 can also be sprayed against the outer wall surface of the storage container 7. Coolant conduits 43 (only one of which is illustrated in FIG. 2) are located in the cooling air passageways 21 for this purpose. The cooling conduits 43 include spray nozzles distributed along their length, through which the coolant is distributed over the outer wall surface of the storage container 7. During the heat takeup, the coolant vaporizes on the outer wall surface of the storage container and on the similarly heated trickling members.

FIG. 2 also schematically illustrates connecting tunnels 44 and inlet gates 45 for the introduction of the radioactive waste. The highly-radioactive waste is brought into the storage space 1 in transport containers 46, through the inlet gate 45. A service platform 47, with crane installations, is located in the storage space 1. The waste capsules which are filled with waste 11 are placed in the storage shafts 10 of the storage container 7.

The transitory or temporary storage vessel, in the exemplary embodiment, evidences an overall height of about 40 meters. Of this height, about 23 meters are encased within the ground, while 17 meters project above the ground surface 3. The outer diameter of the transitory storage is about 15 meters. The storage space has a chamber diameter of about 9 meters, the storage container is designed with an outer diameter of about 6 meters. The described transitory storage vessel can house approximately 450 waste capsules each having a diameter of 0.4 meter and a height of 1.3 meters. The cooling and the safety of the transitory storage is so designed that the highly-radioactive waste can be stored in a secure encapsulated condition over lengthy time periods.

What is claimed is:

1. A storage vessel for radioactive waste comprising:

outside storage walls forming an enclosed storage space;

an axially extending storage container supported in the storage space and forming a plurality of axially extending storage shafts for receiving the radioactive waste;

a primary cooling circuit for conducting a cooling fluid from a source thereof, through the storage container, and to heat a sink to remove heat produced in the storage container, the primary cooling circuit including a multitude of axially extending cooling conduits forming a pattern encompassing the storage shafts; and a cooling mantle extending around the storage container and forming therewith an axially extending cooling air passageway for conducting air upward past the outside of the storage container;

the outside storage walls and the storage container forming an air distribution chamber, below the storage container, to distribute cooling air to the air passageway;

the outside storage walls including internal air conduit means for conducting air downward, through the storage walls, from an upper portion of the storage vessel to the distribution chamber said cooling air passageway, air distribution chamber, and internal air conduit means comprising an auxiliary, air cooling circuit for the storage container.

2. A storage vessel according to claim 1 wherein:

the storage container has a cylindrical shape defining a container axis;

the storage shafts extend parallel with the container axis;

the cooling conduits are located in a peripheral region of the storage container that extends around the storage shaft; and the vessel further includes means to close first ends of the storage shafts.

3. A storage vessel according to claim 1 wherein the storage container comprises a plurality of engaged container components, said components forming radiation screening joints between said components.

4. A storage vessel according to claim 3 wherein the container components have cylindrical shapes and are joined together along axial end surfaces.

5. A storage vessel according to claim 1 wherein:

the storage container further forms a central axially extending passageway in communication with the distribution chamber for receiving cooling air therefrom; and the cooling conduits are arranged in a region of the storage container adjacent the central passageway.

6. A storage vessel according to claim 1 further comprising a plurality of shaft liners, each shaft liner located in a storage shaft, in contact with the surfaces of the storage container forming the storage shaft.

7. A storage vessel according to claim 1 wherein:

the storage container further forms a multitude of cooling shafts; and the cooling conduits are located in the cooling shafts, in a close fit with the surfaces of the storage container forming the cooling shafts.

8. A storage vessel according to claim 1 wherein:

each cooling conduit includes (i) an outside pipe having an open first end and a closed second end, and (ii) an inside pipe located inside the outside pipe, and having open first and second ends for conducting the cooling fluid into the second end of the outside pipe; and the primary cooling circuit further includes (i) an inlet for conducting the cooling fluid into the first end of the inside pipe, and (ii) an outlet for receiving the cooling fluid from the first end of the outside pipe.

9. A storage vessel according to claim 1 wherein the storage container is made of cast iron, spheroidal graphite iron, or cast steel.

10. A storage vessel according to claim 9 wherein:

the storage container is comprised of a plurality of individual cylindrical components, said components being axially stacked together; and the storage vessel further includes a plurality of cables holding said cylindrical components together.

11. A storage vessel according to claim 10 wherein:

the cylindrical components form cable bores extending parallel with and between the cooling conduits; and the cables extend through the cable bores.

12. A storage vessel according to claim 1 wherein the cylindrical components form a plurality of joints and are hermetically welded together along said joints.

13. A storage vessel according to claim 1 and further comprising a fire-resistant wall extending around the storage container, inside the outside storage walls.

14. A storage vessel according to claim 1 wherein:

the storage container is vertically positioned; and the storage shafts include top openings for receiving the radioactive waste.

15. A storage vessel according to claim 1 and further comrprising support means supporting the storage means and the cooling mantel, said support means being located in the distribution chamber in the path of the cooling air passing therethrough.

16. A storage vessel according to claim 1 wherein:

the cooling mantle includes a multitude of U-shaped sections, each U-shaped section having a base and a pair of legs extending therefrom;

the bases of the U-shaped sections extend around the storage container and the legs of the U-shaped sections extend inward toward the storage container, to positions slightly spaced therefrom, the U-shaped sections forming a multitude of spaced and connected air channels for conducting air upward past the storage container.

17. A storage vessel according to claim 1 wherein:

the storage container further forms a central axially extending passageway in communication with the distribution chamber for receiving cooling air therefrom and conducting the cooling air upward through the storage container; and the vessel further comprises means for conducting a liquid into the central passageway to further cool the storage container.

18. A storage vessel according to claim 1 wherein the means for conducting the liquid into the central passageway includes spray means to spray the liquid onto the surfaces of the storage container forming the central passageway.

19. A storage vessel according to claim 1 wherein the internal air conduit means include:

a main axial portion extending between upper and lower portions of the storage vessel;

an inlet portion extending from said upper portion and an outside surface of the outside storage walls to conduct air from the ambient into said main portion;

an outlet portion radially extending from the main portion to the distribution chamber to conduct the cooling air therebetween; and means for opening and closing the inlet portion.

20. A storage vessel according to claim 19 and further including an air collection chamber located above the storage container and in communication with the air passageway to collect the cooling air therefrom, said collection chamber including vent means to discharge the cooling air to the ambient.

* * * * *

UNITED STATES PATENT AND TRADEMARK OFFICE

CERTIFICATE OF CORRECTION

PATENT NO. : 4,634,875

DATED : January 6, 1987

INVENTOR(S) : Kurt Kugeler, et al.

It is certified that error appears in the above-identified patent and that said Letters Patent is hereby corrected as shown below:

Column 1, line 57: "for and cooling" should read --for the cooling--

Column 4, line 11: "passageways, provision is made not only for an improved" should read --passageways result in an improved--

Column 4, line 68: "waste To" should read --waste. To--

Column 5, line 46: "constructed to fact" should read --constructed to face--

Column 5, line 50: "legs 24 point" should read --legs 25 point--

Column 6, line 13-14: "connected the upper" should read --connected to the upper--

UNITED STATES PATENT AND TRADEMARK OFFICE

CERTIFICATE OF CORRECTION

PATENT NO. : 4,634,875 Page 2 of 2

DATED : January 6, 1987

INVENTOR(S) : Kurt Kugeler, et al.

It is certified that error appears in the above-identified patent and that said Letters Patent is hereby corrected as shown below:

Claim 18, Column 10, line 12: change "1" to read --6--

Signed and Sealed this

Twenty-second Day of September, 1987

*Attest:*

DONALD J. QUIGG

*Attesting Officer* *Commissioner of Patents and Trademarks*